US005409501A

United States Patent [19]

Zauns-Huber et al.

[11] Patent Number: 5,409,501

[45] Date of Patent: Apr. 25, 1995

[54] DILUTABLE ALUMINUM TRIFORMATE TANNING AGENTS IN THE FORM OF HIGHLY CONCENTRATED, STORABLE AQUEOUS SOLUTIONS AND THEIR USE

[75] Inventors: Rudolf Zauns-Huber, Duesseldorf; Jochen Hieber, Hilden; Loert de Riese-Meyer; Christine Schroeder, both of Duesseldorf, all of Germany

[73] Assignee: Henkel Kommanditgesellschaft auf Aktien, Duesseldorf, Germany

[21] Appl. No.: 182,009

[22] PCT Filed: Jul. 6, 1992

[86] PCT No.: PCT/EP92/01518

§ 371 Date: Mar. 14, 1994

§ 102(e) Date: Mar. 14, 1994

[87] PCT Pub. No.: WO93/02218

PCT Pub. Date: Feb. 4, 1993

[30] Foreign Application Priority Data

Jul. 15, 1991 [DE] Germany ..... 41 23 357.3

[51] Int. Cl.[6] ..... C14C 3/04

[52] U.S. Cl. ..... 8/94.29; 8/94.25; 8/94.26; 252/8.57

[58] Field of Search ..... 8/94.25, 94.26, 94.29, 8/94.21, 94.33, 94.18; 252/8.57

[56] References Cited

U.S. PATENT DOCUMENTS

| | | | |
|---|---|---|---|
| 1,421,723 | 7/1922 | Rohm | 8/94.29 |
| 2,071,567 | 2/1937 | Pensel | 8/94.29 |
| 2,301,637 | 11/1942 | Niedercorn et al. | 8/94.29 |

FOREIGN PATENT DOCUMENTS

| | | |
|---|---|---|
| 3016875 | 11/1981 | Germany . |
| 4010930 | 10/1991 | Germany . |
| 0136193 | 1/1920 | United Kingdom . |

*Primary Examiner*—Prince Willis, Jr.
*Assistant Examiner*—Alan D. Diamond
*Attorney, Agent, or Firm*—Ernest G. Szoke; Wayne C. Jaeschke; Daniel S. Ortiz

[57] ABSTRACT

Described is the use of at least substantially storage-stable supersaturated and acidified aqueous solutions of mixtures of aluminum triformate and alkali-metal and/or alkaline-earth formates as a means of supplying a water-dissolved mineral tanning agent based on aluminum formate for the tanning of leather and/or hides using little or no chromium. The invention thus concerns, in particular, storage-stabilized supersaturated and acidified aqueous solutions of this kind which also contain small quantities of stabilizers, preferred stabilizers being 1,2,3,4-butanetetracarboxylic acid and/or xanthane gum. The invention also concerns the use of such stabilized supersaturated aqueous forms of aluminum triformate solutions for use as tanning auxiliaries with a fixing and/or tanning action in the tanning or finishing of leather and hides.

16 Claims, No Drawings

DILUTABLE ALUMINUM TRIFORMATE TANNING AGENTS IN THE FORM OF HIGHLY CONCENTRATED, STORABLE AQUEOUS SOLUTIONS AND THEIR USE

This application is a 371 of PCT/EP92/01518 filed Jul. 6, 1992.

1. Field of the Invention

This invention relates to and describes a new highly concentrated form of aluminium triformate in supersaturated, but storable aqueous solution which is particularly suitable for use in the chrome-free or low-chrome mineral tanning of leather and/or skins. The highly concentrated aqueous solutions according to the invention are distinguished from commercially available aluminium-based mineral tanning agents hot only by the fact that, in their case, the active component—aluminium triformate—is already present in the form of an aqueous solution, but also by the fact that this formulation of the mineral tanning agent affords a number of improvements and simplifications in the tanning, finishing and dressing of leather and pelts.

2. Background of the Invention

Considerable significance is attributed to the use of aluminium-based mineral tanning agents and auxiliaries, such as fixing aids, in the production and finishing of leather and skins. The reason for this lies in the wide-scale ecological criticism of the chrome-based auxiliaries of this type which, hitherto, have mainly been used. In practice, aluminium-based mineral tanning agents are available in particular in two forms of which both are solid, namely solid basic aluminium chloride and finely crystalline solid aluminium triformate, which are used as starting materials in the leather and fur manufacturing industry. So far as the results obtained are concerned, the advantages arising out of the simultaneous use of aluminium and lower carboxylic acids, for example in the form of aluminium triformate, are well known. A disadvantage in this regard lies in the comparatively poor solubility of pure crystalline aluminium triformate in aqueous solutions which amounts to less than 5% by weight at typical tanning temperatures. This would also appear to be the key to the fact that, hitherto, aqueous formulations of aluminium triformate have not acquired any practical significance as a starting material for the leather and fur manufacturing industry.

The problem addressed by the present invention was to provide water-based concentrates which would contain aluminium triformate in concentrations far above its solubility in water, but which would nevertheless be stable in storage and could be adjusted to the particular aluminium concentration required simply by dilution at the leather factory. The solution to the problem addressed by the invention is based on the observation that highly concentrated, aqueous concentrates based on aluminium triformate, in which this useful material is present in supersaturated, but storable form, can be prepared under certain conditions which are described in detail in the following. It has also been found that the use of such formulations of the mineral tanning agents and auxiliaries can afford further advantages reflected, for example, in a hitherto unknown degree of liquor extraction.

BRIEF SUMMARY OF THE INVENTION

Accordingly, a first embodiment of the invention relates to the use of at least substantially storage-stable, oversaturated and acidified aqueous solutions of mixtures of aluminium triformate with alkali metal and/or alkaline earth metal formate (hereinafter also referred to as "formate salts") as a concentrated formulation of an aluminium-triformate-based mineral tanning agent in the form of an aqueous solution for the chrome-free or low-chrome tanning of leather and/or skins.

In one important embodiment of the invention, these supersaturated aqueous solutions of formate salts contain small quantities of selected acid-stable stabilizers. Particular significance is attributed in this regard to the addition of butane tetracarboxylic acid as a stabilizer for the supersaturated active-substance solutions, although selected organic polymer compounds are also suitable for the virtually indefinite stabilization in storage of these supersaturated formate salt solutions.

In another embodiment, therefore, the invention relates to storage-stabilized, supersaturated and acidified aqueous solutions of aluminium triformate in admixture with sodium formate with solids contents of the formate salt mixtures of at least 35% by weight and preferably at least 40% by weight which contain small quantities of butane tetracarboxylic acid and/or xanthan gum as stabilizers.

Finally, in another embodiment, the teaching according to the invention encompasses the use of these stabilized supersaturated aqueous formate salt solutions as a water-dilutable aluminium triformate preparation already dissolved in water for use as a tanning auxiliary with a fixing and/or tanning effect in the tanning and/or dressing and leather and skins.

DETAILED DESCRIPTION OF THE INVENTION

The teaching according to the invention is based on the disclosure of earlier, filed German patent application P 40 10 930.5corresponds to U.S. application Ser. No. 5170 08-167- 837, (DE 40 10 930) which is hereby incorporated by reference as part of the disclosure of the present invention.

This earlier patent application describes a process for the production of an aluminium triformate solution containing alkali metal and/or alkaline earth metal from an aluminate liquor using formic acid, characterized in that an aqueous aluminate liquor containing alkali metal and/or alkaline earth metal is neutralized with formic acid introduced beforehand and the solid precipitated is converted into an aluminium triformate solution by an increase in temperature Aqueous sodium aluminate liquors are preferably used for the reaction. The ratios by weight of sodium oxide to aluminium oxide in the aluminate liquors may vary over a wide range, for example from 5:1 to 1:5, ratios by weight of 2:1 to 1:2 being preferred.

The following reaction parameters can be of importance for the preparation of a supersaturated aluminium triformate solution on this basis. In general, the formic acid has to be introduced first and the aluminate liquor subsequently added dropwise. The reaction takes place in two steps. During addition of the liquor, a jelly-like readily stirrable precipitate is increasingly formed in an exothermic reaction. This precipitate can be redissolved in a second step by heating, little or no reprecipitation occurring after cooling. In the reactions, formic acid and aluminate liquor are used in stoichiometric ratios in regard to the formation of sodium formate and aluminium triformate.

It has proved to be important to dissipate the heat of reaction generated during neutralization, particularly in the production of corresponding supersaturated solutions with high contents of formate salts of preferably above 40% by weight and, more preferably, above 50% by weight. Internal temperatures of the reaction mixture of the order of 25° to 30° C. should be avoided as far as possible in the neutralization step. After the aluminate has been added, the: crude product solution has to be heated in a second step, for example to temperatures in the range from about 60° to 80° C., to dissolve the precipitate intermediately formed until a clear solution is obtained. After subsequent cooling to room temperature, the product solution initially remains clear. In the event of prolonged standing (for a few weeks or months), slight clouding can recur although the solution remains oversaturated.

According to the teaching of the earlier application cited above, the aluminium triformate solutions containing alkali metal and/or alkaline earth metal are used for various applications, for example for impregnating textiles, in disinfectants and cleaning preparations, as lacquer coagulants and, finally, as fixing auxiliaries in the treatment of leather. However, the direct use of the oversaturated aqueous aluminium triformate solutions as a mineral tanning agent for the production of chrome-free or at least low-chrome leather is not mentioned in the earlier application.

The significance and chemical nature of tanning materials on the one hand and fixing agents on the other hand in the production or finishing of leather are not the same. Although it is known that selected tanning agents may also be used as fixing agents in the finishing of leather, a fixing agent for the finishing of leather cannot normally be used as a tanning agent for the production of leather from correspondingly prepared natural skins. In this respect alone, the teaching according to the invention with its intended application for highly concentrated, supersaturated aqueous formate salt solutions based on aluminium triformate goes beyond the teaching of the earlier application cited above.

In the preferred embodiment of the invention, small quantities of selected acid-resistant stabilizers are also used, as mentioned above, special significance being attributed to butane tetracarboxylic acid and in particular to 1,2,3,4-butanetetracarboxylic acid. Even extremely high concentrations of the formate salts in the supersaturated aqueous solution—preferably amounting to more than 50% by weight and, in particular, to between 55 and 60% by weight—are stabilized by the addition of small quantities of this stabilizer so effectively that the supersaturated concentrates remain stable in storage for several months, even at varying temperatures such as typically encountered in practice. This represents a major advance not only in the field of mineral tanning agents based on aluminium triformate, but also in the field of fixing agents: for finishing leather mentioned in the earlier application cited above which is significantly promoted by the teaching according to the invention, so that in overall terms the teaching according to the invention is also applicable to the finishing of leather as discussed in the earlier application.

The supersaturated aqueous solutions of the formate salts to be used in accordance with the invention, as described in the foregoing, contain aluminium triformate in combination with, in particular, sodium formate Salt mixtures of this type may readily be prepared from the inexpensively available sodium aluminate solutions by reaction with formic acid. The formate salt solids contents in the aqueous concentrates amount to at least about 35% by weight and preferably to at least about 40% by weight. In the embodiments of particular interest according to the invention, the formate salt contents are above 50% by weight and, in particular, in the range from about 55 to 60% by weight.

Although, basically, the mixing ratios of aluminium triformate to sodium formate can vary over a wide range, as disclosed in earlier application DE 40 10 930 cited above, mixing ratios of aluminium triformate to sodium formate of the order of 0.5 to 2:1, based on the ratio by weight of the: two components in oxide form, i.e. based on the ratio by weight of $Al_2O_3$ to $Na_2O$, are preferred for the teaching according to the invention.

The quantity ratios of formic acid on the one hand and formate-forming metal components on the other hand, i.e. in particular aluminium and sodium, are substantially stoichiometric in the preferred production process. Monitoring the pH value of the supersaturated aqueous concentrates may be advisable or even necessary to ensure the stability in storage of the supersaturated solutions in accordance with the teaching of the invention. In the preferred embodiment, the concentrates have mildly acidic pH values which, in particular, do not exceed pH 5. The pH range from about 3 to 4 can be particularly suitable in regard to the degree of acidity to be established in the aqueous concentrates.

The stabilizers according to the invention are, on the one hand, 1,2,3,4-butane tetracarboxylic acid, as already emphasized, and also acid-stable water-soluble and/or water-swellable polymer compounds, among which particular significance is attributed to xanthan gum. The stabilizers are best used in quantities below 5% by weight, based on the aqueous concentrate, and more particularly in quantities of from about 0.1 to about 2% by weight in the aqueous concentrate. It may be advisable to introduce the stabilizers into the mixture containing the formate salt in the form of aqueous solutions, for example .approximately 10% by weight aqueous solutions, or even after preliminary swelling, for example in isopropanol.

Butane tetracarboxylic acid is a suitable stabilizer, particularly where the concentrates according to the invention are used as mineral tanning agents for the production of chrome-free or low-chrome leathers and skins and, in a preferred embodiment, may be added to the formate salt concentrates in quantities of about 0.5 to 1% by weight, based on the aqueous concentrate. Aqueous preparations of this type show virtually indefinite stability in storage, even when the formate salt concentrations amount to or exceed 50% by weight.

The stabilizer, for example butane tetracarboxylic acid, may be added during the preparation of the water-containing concentrates, for example before the reaction product initially obtained is finally heated to prepare the supersaturated aqueous solutions. However, the stabilizer may also be subsequently added to the final concentrates in a concluding process step.

The formulations of mineral tanning agents based on aluminium triformate according to the present invention are distinguished by outstanding performance advantages in the tanning and finishing of leather and skins, including for example ready dosability, ready dispersion of the mineral tanning agent in the tanning liquor, neutrality of odor and, above all, the ready absorption of $Al_2O_3$ by the skin. Extensive comparison tests, which will be discussed in more detail in the following Examples, have shown that the use of comparatively low concentrations of aluminium triformate in the tanning liquors gives results comparable in regard to the product properties to the results obtained by hitherto known mineral aluminium-based tanning processes using the corresponding products described above based on solids. At the same time, however, this provides for distinctly better extraction of the liquors, so that not only is the percentage degree of extraction of the liquor distinctly increased in relation to known processes, the residual aluminium content of the liquor can also be significantly reduced by the teaching according to the invention.

The invention is illustrated by the following Examples.

EXAMPLES

Examples 1 and 2 below describe the preparation of characteristic representatives of the supersaturated concentrated formate salt solutions to be used in accordance with the invention.

EXAMPLE 1

2000 g of sodium aluminate liquor (14.3% by weight of $Na_2O$ and 11.3% by weight of $Al_2O_3$) were added dropwise over a period of 30 minutes to 1210 g of an 85% by weight aqueous formic acid (or 1030 g of pure formic acid). An increase in temperature to 80° C. and precipitation occurred. The mixture was then heated under reflux until a clear solution was obtained. The yellow product solution contained 23.0% by weight (or 24.3% by weight) of aluminium triformate (corresponding to 7.3% by weight of $Al_2O_3$ or 7.6% by weight of $Al_2O_3$) and 19.5% by weight (or 20.7% by weight) of sodium formate.

In further tests, an aluminate liquor of higher concentration was used to increase the concentration of aluminium triformate. The sodium aluminate solution marketed by Hüls AG under the name o f "DYNAFLOCK L" containing 19% by weight of $Na_2O$ and 25% by weight of $Al_2O_3$ was used. In the neutralization reaction of this aluminate liquor with formic acid under the conditions mentioned above, it was found that, initially, it was not possible to obtain clear products. However, further tests then showed that, by careful temperature control, the storable, clear highly supersaturated aqueous solutions required could be obtained in this case, too. The following measures were adopted for this purpose:

When the concentrated aluminate liquor was added dropwise to formic acid, a white, jelly-like and readily stirrable precipitate accumulated in the first step. In order subsequently to obtain a clear product solution, the heat of reaction had to be dissipated. Temperatures in the flask above about 25° C. had to be avoided. The dropwise addition rate was thus dependent upon the effectiveness of cooling. After the aluminate had been added, the crude product solution had to be heated at 60° C. in a second step to dissolve the precipitate until a clear solution was obtained. After subsequent cooling to room temperature, the product solution remained clear. Particulars can be found in Example 2 below.

EXAMPLE 2

2000 g of DYNAFLOCK L (sodium aluminate solution: 19% by weight of $Na_2O$ and 25% by weight of $Al_2O_3$; a product of Hüls AG) were added dropwise with vigorous stirring to 2260 g of an 85% aqueous formic acid with external cooling using cold water. The dropwise addition rate was determined by the temperature of the reaction solution which was not to exceed 25° C. The solution was then stirred at 60° C. until a clear solution was obtained (approximately 10 minutes). The clear colorless solution contained 37.3% by weight of aluminium triformate (corresponding to 11.75% by weight of $Al_2O_3$) and 19.6% by weight of sodium formate.

Lasting stabilization of the supersaturated solution was obtained by addition of 1,2,3,4-butane tetracarboxylic acid (BTCA). BTCA was used in quantities of 0.1 to 1.5% by weight, based on aqueous concentrate, either in the form of pure substance or in the form of an aqueous solution, preferably a 10% by weight aqueous solution. Quantities of BTCA of 0.5 to 0.7% by weight lead to stable, readily stirrable systems. A quantity of 1.0% by weight of BTCA produced a pseudoplastic system. Storage tests at varying temperatures (−30° to 60° C.) with the BTCA-stabilized solutions showed that they withstood the extreme variations in temperatures for 6 weeks.

In a series of performance tests, the concentrates according to the invention were used as tanning agents and were compared with commercial products based on basic aluminium chloride or solid finely crystalline aluminium triformate.

The comparison products used were the basic aluminium chloride complex salt marketed by applicants under the name of "Pellutax ALP" (aluminium content ($Al_2O_3$) 16 to 18% by weight; basicity approximately 20%) and the product marketed by Zschimmer and Schwarz under the name of "Novaltan AL" (approximately 23% of $Al_2O_3$).

Particulars of the comparison tests are given in the following. The following summary observations may be made beforehand:

Where the mineral tanning agents tested were used on pickled German sheepskins, there were no discernible differences in the evaluation criteria of feel, softness, fullness and color of wool and leather. The aluminium tanning agents stabilized with BTCA in accordance with the invention contained distinctly less active substance (aluminium compounds) in the mixture. However, these active substances were better available for the tanning process, resulting in more favorable extraction of the liquor. The difference between the aluminium triformate available in the liquor and the aluminium absorbed by the sheepskin is smaller than in the comparison products.

The tanning tests

Two tanning agents based on aluminium triformate/sodium triformate, stabilized with BTCA, formulated in accordance with the invention as liquids were used together with the commercial products mentioned. Formate mixture EP-1 produced in accordance with the invention (Esample 2) contained 0.5% by weight of BTCA, based on aqueous concentrate. Formate mixture EP-2 produced in accordance with the invention (Example 2) contained 1.0% by weight of BTCA, based on aqueous concentrate. The two products were each stabilized with a 10% by weight aqueous BTCA solution.

The mineral tanning agents to be compared with one another were used in equal quantities by weight. The comparison tests were carried out with pickled German sheepskins. Before tanning, the corresponding skin halves were sheared to a wool height of 20 mm, subsequently trimmed and equalized in weight.

To complete the series of tests and to test the behavior of the tanning agents on leather, the corresponding pickled pelt halves which originated from the same raw material and which were specially softened, painted, dewooled, limed, bated, degreased and pickled for these tests were included in the same series. The weights of the pickled pelts were adjusted to the same value. The starting basis for calculation of the quantity of liquor was the pickled weight of the skins. The liquor ratio was 1:10. The quantity of the chemicals used was standardized to g/l and calculated accordingly.

The following products were tested against one another in the same quantities:

| | |
|---|---|
| 1. Pellutax ALP | 17% by weight of $Al_2O_3$ |
| 2. Novaltan AL | 23.5% by weight of $Al_2O_3$ |
| 3. EP-1 | 11.2% by weight of $Al_2O_3$<br>0.5% by weight of 1,2,3,4-butane tetracarboxylic acid |
| 4. EP-2 | 10.6% by weight of $Al_2O_3$<br>1% by weight of 1,2,3,4-butane tetracarboxylic acid. |

Tanning: Liquor ratio 1:10, based on pickled weight, mins. stands for minutes

| | | | |
|---|---|---|---|
| | | Water 30° C. | |
| + | 40 g/l | Salt | |
| | 3 g/l | Electrolyte-stable oiling agent (commercial product "Pellan PRE") | |
| | 3 g/l | Electrolyte-stable oiling agent (commercial product "Pellasan GF") | |
| | | Mix | |
| | | Run | 10 mins. |
| + | | Introduce skins into liquor | |
| | | Run | 30 mins. |
| + | 4 g/l | Aldehyde tanning agent "Drasil 8/89" | |
| | | Run | 120 mins. |
| | | pH 3.9–4.0 | |
| + | 15 g/l | Test product (Al tanning agent) | |
| | | Run | 60 mins. |
| | | To automatic overnight | |
| | | Stand | 30 mins. |
| | | Run | 1 min. |
| + | 1.5 g/l | Sodium bicarbonate | |
| | | Run | 60 mins. |
| + | 0.5 g/l | Soda | |
| | | Run | 60 mins. |

-continued

| | | |
|---|---|---|
| | pH 4 to 4.2 | |
| + | Run | 240 mins. |
| | Then hoard up skins, store for 48 hours. | |

The liquor pH value of the various tannings was electrochemically measured a) before addition of the Al tanning agent
b) 30 minutes after addition of the Al tanning agent
c) 4 hours after addition of the Al tanning agent
d) 14 hours after addition of the Al tanning agent
e) 4 hours after basification of the Al tanning agent The results are shown in Table 1 below.

TABLE 1

| pH value of the liquor | Pellutax ALP | Novaltan AL | EP-1 | EP-2 |
|---|---|---|---|---|
| a) Before addition of the Al tanning agent | 3.9 | 3.9 | 4.0 | 4.0 |
| b) 30 Mins. after addition of the Al tanning agent | 3.7 | 3.8 | 3.9 | 3.9 |
| c) 4 h after addition of the Al tanning agent | 3.7 | 3.8 | 3.9 | 3.9 |
| d) 14 h after addition of the Al tanning agent | 3.7 | 3.8 | 4.0 | 3.9 |
| e) 4 h after basification | 4.1 | 4.1 | 4.2 | 4.2 |

TABLE 2

| Tanning agents | g/l $Al_2O_3$ after addition (3 mins.) | Analytically determined $Al_2O_3$ values of the residual liquors: g/l $Al_2O_3$ after 30 mins. | g/l $Al_2O_3$ after 4 h | g/l $Al_2O_3$ after 14 h | g/l $Al_2O_3$ 4 h after basification | g/l $Al_2O_3$ taken up by leather | Degree of extraction of the liquor | Shrinkage temperature |
|---|---|---|---|---|---|---|---|---|
| Pellutax ALP g/l $Al_2O_3$ powder | 2.55 | 2.20 | 2.00 | 1.80 | 1.70 | 0.85 | 33.3% | 55.7° C. |
| Novaltan AL g/l $Al_2O_3$ powder | 3.52 | 3.0 | 2.80 | 2.70 | 2.40 | 1.12 | 31.8% | 57.2° C. |
| EP-1 g/l $Al_2O_3$ liquid | 1.59 | 1.40 | 1.0 | 1.0 | 0.90 | 0.69 | 43.4% | 54.5° C. |
| EP-2 g/l $Al_2O_3$ thixotropic | 1.59 | 1.40 | 1.00 | 1.00 | 0.90 | 0.69 | 43.4% | 55° C. |

TABLE 3

| | $Al_2O_3$ taken up by the skin: Tanning agent used: Pellutax ALP | Novaltan AL | EP-1 | EP-2 |
|---|---|---|---|---|
| Initial quantity g/l $Al_2O_3$ | 2.55 | 3.52 | 1.59 | 1.59 |
| Degree of extraction in % after 3 mins. | 0 | 0 | 0 | 0 |
| Uptake in g/l after 30 mins. | 0.35 | 0.52 | 0.19 | 0.19 |
| Degree of extraction uptake in % after 30 mins. | 13.72 | 14.77 | 11.94 | 11.94 |
| Uptake in g/l after 6 h | 0.55 | 0.72 | 0.59 | 0.59 |

TABLE 3-continued

| | $Al_2O_3$ taken up by the skin | | | |
|---|---|---|---|---|
| | Tanning agent used | | | |
| | Pellutax ALP | Novaltan AL | EP-1 | EP-2 |
| Degree of extraction uptake in % after 6 h | 21.56 | 20.45 | 37.10 | 37.10 |
| Uptake in g/l after 14 h | 0.75 | 0.82 | 0.59 | 0.59 |
| Degree of extraction uptake in % after 14 h | 29.41 | 23.29 | 37.10 | 37.10 |
| Uptake in g/l basify after 4 h | 0.85 | 1.12 | 0.69 | 0.69 |
| Degree of extraction uptake in % basify after 4 h | 33.3 | 31.8 | 43.4 | 43.4 |

The product properties were evaluated in a number of comparison tests as shown in Table 4 below. The figures in this table represent scores (10=very good, 1=very poor)

TABLE 4

| Products used / Test number | Pellutax ALP 61 | Novaltan AL 61A | Pellutax ALP 62 | Novaltan AL 62A | Pellutax ALP 63 | EP-2 63A |
|---|---|---|---|---|---|---|
| 1. Feel/softness | 8 | 8 | 8 | 8 | 5 | 5 |
| 2. Fullness | 8 | 8 | 8 | 8 | 9 | 9 |
| 3. Oiliness (10 = oily) | 7 | 7 | 7 | 7 | 7 | 7 |
| 4. Color/wool | 10 | 10 | 10 | 10 | 10 | 10 |
| 5. Color/leather | 9 | 9 | 9 | 9 | 9 | 9 |
| 6. Product appearance | 7 | 8 | 7 | 8 | 7 | 9 |
| 7. Solubility | 6 | 8 | 6 | 8 | 6 | 10 |

| Products used / Test numbers | Pellutax ALP 64 | EP-2 64A | Novaltan AL 65 | EP-2 65A | Novaltan AL 66 | EP-2 66A |
|---|---|---|---|---|---|---|
| 1. Feel/softness | 7 | 7 | 7 | 7 | 6 | 6 |
| 2. Fullness | 8 | 8 | 8 | 8 | 8 | 8 |
| 3. Oiliness (10 = oily) | 7 | 7 | 7 | 7 | 7 | 7 |
| 4. Color/wool | 10 | 10 | 10 | 10 | 10 | 10 |
| 5. Color/leather | 9 | 9 | 9 | 9 | 9 | 9 |
| 6. Product appearance | 7 | 9 | 8 | 9 | 8 | 9 |
| 7. Solubility | 6 | 10 | 8 | 10 | 8 | 10 |

TABLE 5

| Products used / Test number | Pellutax ALP 67 | Novaltan AL 67A | Pellutax ALP 68 | Novaltan AL 68A | Pellutax ALP 69 | EP-1 69A |
|---|---|---|---|---|---|---|
| 1. Feel/softness | 7 | 7 | 7 | 7 | 7+ | 7+ |
| 2. Fullness | 8 | 8 | 8 | 8 | 8 | 8 |
| 3. Oiliness (10 = oily) | 7 | 7 | 7 | 7 | 7 | 7 |
| 4. Color/wool | 10 | 10 | 10 | 10 | 10 | 10 |
| 5. Color/leather | 9 | 9 | 9 | 9 | 9 | 9 |
| 6. Product appearance | 7 | 8 | 7 | 8 | 7 | 9 |
| 7. Solubility | 6 | 8 | 6 | 8 | 6 | 10 |

TABLE 5-continued

| Products used / Test numbers | lutax ALP 70 | EP-1 70A | valtan AL 71 | EP-1 71A | valtan AL 72 | EP-1 72A |
|---|---|---|---|---|---|---|
| 1. Feel/softness | 8 | 8 | 7+ | 7+ | 7 | 7 |
| 2. Fullness | 8 | 8 | 7+ | 7+ | 7 | 7 |
| 3. Oiliness (10 = oily) | 7 | 7 | 7 | 7 | 7 | 7 |
| 4. Color/wool | 10 | 10 | 10 | 10 | 10 | 10 |
| 5. Color/leather | 9 | 9 | 9 | 9 | 9 | 9 |
| 6. Product appearance | 7 | 9 | 8 | 9 | 8 | 9 |
| 7. Solubility | 6 | 10 | 8 | 10 | 8 | 10 |

TABLE 6

The $Al_2O_3$ content of the corresponding skin halves ($Al_2O_3$ content at 0% $H_2O$) is shown in Table 6 below.

| Skin No. | Tanning agent | % by weight $Al_2O_3$ | Skin No. | Tanning agent | % by weight $Al_2O_3$ |
|---|---|---|---|---|---|
| 61 | Pellutax ALP | 1.30 | 61 A | Novaltan AL | 1.90 |
| 62 | Pellutax ALP | 1.60 | 62 A | Novaltan AL | 2.00 |
| 63 | Pellutax ALP | 1.30 | 63 A | EP-2 | 1.30 |
| 64 | Pellutax ALP | 1.80 | 64 A | EP-2 | 2.00 |
| 69 | Pellutax ALP | 1.40 | 69 A | EP-1 | 1.50 |
| 79 | Pellutax ALP | 1.80 | 70 A | EP-1 | 1.80 |
| 65 | Novaltan AL | 2.00 | 65 A | EP-2 | 1.60 |
| 66 | Novaltan AL | 1.60 | 66 A | EP-2 | 1.10 |
| 71 | Novaltan AL | 1.90 | 71 A | EP-1 | 1.70 |
| 72 | Novaltan AL | 1.90 | 72 A | EP-1 | 1.50 |

Evaluation of the skins and leathers did not reveal any quality differences in regard to feel, softness, fullness and whiteness of the leather and the wool. The two products according to the invention showed advantages over Pellutax ALP in terms of effective binding and the $Al_2O_3$ taken up by the leather. Where Pellutax ALP (17% by weight $Al_2O_3$) was used, no more $Al_2O_3$ was incorporated in the leather despite the relatively high concentration. The $Al_2O_3$ content of the skins tanned with products EP-1 and EP-2 according to the invention was higher than that of the skins tanned with Pellutax ALP.

We claim:

1. In a process for tanning leather wherein the leather is contacted with a tanning agent in an aqueous acidic solution, the improvement which comprises: diluting an acidic supersaturated, aqueous solution of formate salts comprising aluminum triformate and at least one of alkali metal formate or alkaline earth metal formate to form an acidic tanning agent solution and contacting the leather with the acidic tanning agent solution.

2. The process of claim 1 wherein the supersaturated solution comprises aluminum triformate and sodium formate formed by a reaction of a sodium aluminate solution with formic acid.

3. The process of claim 1 wherein the supersaturated solution contains at least 35% by weight of formate salts.

4. The process of claim 3 wherein the supersaturated solution contains at least 40% by weight of formate salts.

5. The process of claim 3 wherein the supersaturated solution contains at least 50% by weight of formate salts.

6. The process of claim 2 wherein the supersaturated solution comprise a ratio of aluminum triformate to sodium formate of from 0.5:1 to 2:1 based on a ratio by weight of $Al_2O_3$ to $Na_2O$.

7. The process of claim 1 wherein the supersaturated solution is at a pH not greater than 5.

8. The process of claim 7 wherein the supersaturated solution is at a pH of from 3 to 4.

9. The process of claim 1 wherein the supersaturated solution is a separation-free readily dilutable concentrate.

10. The process of claim 9 wherein the supersaturated solution is stabilized by up to 5% by weight of an acid resistant stabilizer.

11. The process of claim 10 wherein the stabilizer is present at a concentration of from 0.1 to 2% by weight.

12. The process of claim 10 wherein the stabilizer comprises at least one material selected form the group consisting of butane tetracarboxylic acid, water soluble polymer compound and water swellable polymer compound.

13. The process of claim 12 wherein the stabilizer comprises butane tetracarboxylic acid.

14. The process of claim 13 wherein the supersaturated solution contains from 0.5 to 1.0% by weight of said butane tetracarboxylic acid.

15. The process of claim 10 wherein the supersaturated solution is formed by reaction of an alkali metal aluminate solution, an alkaline earth metal aluminate solution or mixtures thereof, with formic acid in about a stoichiometric ratio at a temperature not greater than 25° C. to form a reaction mixture and heating the reaction mixture to a temperature in the range of 60° C. to 80° C., the stabilizer being added before or after the heating step.

16. The process of claim 15 wherein the stabilizer is butane tetracarboxylic acid.

* * * * *